US006345620B2

(12) United States Patent
Salapow et al.

(10) Patent No.: US 6,345,620 B2
(45) Date of Patent: Feb. 12, 2002

(54) FLEXIBLE RESPIRATOR FILTER

(75) Inventors: Thomas M. Salapow, Ellwood City; Roger P. Wolf, Butler; Paul A. Zeller, Pittsburgh, all of PA (US)

(73) Assignee: Mine Safety Appliances Company, Pittsburgh, PA (US)

( * ) Notice: Subject to any disclaimer, the term of this patent is extended or adjusted under 35 U.S.C. 154(b) by 0 days.

(21) Appl. No.: 09/217,165

(22) Filed: Dec. 21, 1998

Related U.S. Application Data

(60) Provisional application No. 60/105,376, filed on Oct. 23, 1998.

(51) Int. Cl.[7] ..... A62B 18/08

(52) U.S. Cl. ..... 128/206.17; 128/205.27; 128/205.29; 128/206.16

(58) Field of Search ..... 128/201.25, 205.27, 128/205.29, 206.12, 206.17, 208.16, 202.27

(56) References Cited

U.S. PATENT DOCUMENTS 2,142,064 A * 12/1938 Whipple ..... 128/206.16
2,205,368 A * 6/1940 Whipple ..... 128/206.16
2,295,119 A * 9/1942 Malcom et al. ..... 128/206.17
RE35,062 E * 10/1995 Brostrom et al. ..... 128/206.12
5,732,695 A * 3/1998 Metzger ..... 128/206.12
5,992,414 A * 11/1999 Tayebi et al. ..... 128/205.27
6,044,842 A * 4/2000 Pereira et al. ..... 128/202.27

* cited by examiner

*Primary Examiner*—John G. Weiss
*Assistant Examiner*—V. Srivastava
(74) *Attorney, Agent, or Firm*—James G. Uber

(57) ABSTRACT

The present invention provides a flexible respirator filter having substantially coextensive front and back portions of filter material which are sealed to each other along their periphery, forming a sealed edge. A flexible plastic frame is contained within the front and back portions to form a plenum between the front and back portions of filter material. The frame has a peripheral edge which remains adjacent to the sealed edge of the filter material along substantially the entire length of the sealed edge to provide sufficient rigidity to prevent crushing while at the same time providing sufficient flexibility to fit under other personal protective equipment. A connector for attaching the filter to the respirator mask is formed integrally with the frame such that it protrudes through the back portion of the filter material. A plurality of recesses are also formed integrally with the frame to facilitate grasping the filter without crushing or damaging it.

20 Claims, 3 Drawing Sheets

FLEXIBLE RESPIRATOR FILTER

This application claims benefit of Prov. No. 60/105,376 filed Oct. 23, 1998.

FIELD OF THE INVENTION

The present invention relates to a respirator filter and, more particularly, to a flexible respirator filter which can be attached easily to a respirator mask without being damaged or crushed.

BACKGROUND OF THE INVENTION

Respirator masks equipped with detachable filters have been used for decades to protect the respiratory system of individuals from noxious gases, vapors, fumes and particulates. The detachable filters are connected to the inlet valves of the respirator mask through which ambient air is drawn as the user inhales. As such, the air is filtered before it is inhaled.

Many respirator filter cartridges are designed as short cylindrical containers having a rigid metal or plastic shell with a filter material such as activated carbon housed inside the container. An example of such filter cartridges is shown and described in U.S. Pat. No. 5,714,126. Due to their rigid shell design, such filter cartridges are inflexible, and if they are thick enough, they sometimes make it difficult for the user to wear certain eye and face protection such as a welding hood. Additionally, sometimes such filter cartridges are thick enough to interfere with a portion of the users vision. In an attempt to overcome these limitations in certain applications where only a particulate filter is required, flexible particulate filters have been designed that easily fit under certain eye and face protection such as a faceshield.

U.S. Pat. No. Re. 35,062 shows a flexible particulate filter having front and back walls of filter material joined to each other along their peripheral edges in a spaced-apart relationship and equipped with a breather tube having an attachment means to secure the filter to a respirator mask. The spaced-apart relationship is maintained by a soft porous layer of specific materials encased within and substantially coextensive with the filter walls. The filter walls must be maintained in a spaced-apart relationship; otherwise the front and back walls would merely collapse together and the filter would not function. While such filters are flexible, their lack of a frame makes them susceptible to being damaged due to soiling and crushing, particularly during attachment and removal. That is, the filter may become dirty or bent such that air cannot be drawn through a portion of the filter. When this happens, the effective surface area of the filter is reduced and the breathing resistance increases. Additionally, the porous layer contributes up to 50% of the total pressure drop of the filter making breathing more difficult.

U.S. Pat. No. 5,732,695 describes a particulate filter which is a hybrid between a flexible filter and a filter cartridge. It has the front and back walls of filter material like a flexible filter but also has a rigid frame having an outer peripheral band connected by a plurality of spacers to an inner breather tube. While this filter has the increased surface area of a flexible filter, the rigid frame prevents flexibility.

The "75 FFP 100" particulate filter made by North Safety Products includes a flexible frame that may be described as having a hub and spokes. The hub of the frame forms a centrally located breather tube which attaches the filter to a respirator mask. The spokes of the frame separate the front and back layers of the filter. Unfortunately, the hub and spoke design results in an interior frame having a sharp point and edges at the end of each spoke. When the user grasps the filter to install or remove it, he or she may grip the filter with sufficient force so as to crush the filter and cause the frame spokes to puncture the filter material thereby damaging the filter. Additionally, because the flexible frame does not extend to the outer edge of the filter material, these filters are also susceptible to bending, folding and crushing.

Accordingly, it would be desirable to have a filter which has the benefits of a flexible particulate filter without the known limitations. This can be accomplished by utilizing a flexible internal frame that extends to the edge of the filter material and is substantially coextensive therewith, thereby providing sufficient rigidity to prevent crushing and damage to the filter during installation while still providing sufficient flexibility to enable the filter to fit under other personal protective equipment.

SUMMARY OF THE INVENTION

Generally, the present invention is directed to a flexible respirator filter comprising a filter material forming substantially coextensive front and back portions which are joined to each other along their periphery forming a sealed edge. The filter material preferably comprises a plurality of layers for better durability and spark resistance and can even include a layer of activated carbon. A frame is at least partially encased within the front and back portions of the filter material such that a peripheral edge of the frame remains adjacent to the sealed edge of the filter material. Preferably the frame is made from a flexible material such as plastic. Alternatively, the frame could be made of a rigid material which is thin enough to be flexible. While the frame itself is flexible, having a peripheral edge adjacent to the sealed edge of the filter material provides enough rigidity to prevent crushing during installation or removal while not being so rigid that the filter will not bend to fit under a welding mask or faceshield.

More particularly, the present invention provides a flexible filter comprising a flexible frame that is totally encased between the front and back layers of filter material and which remains substantially coextensive with and immediately adjacent to the sealed peripheral edge of the filter material along substantially its entire length. Thus, the shape of the filter is maintained and crushing does not occur. Preferably the internal frame is generally round and does not have any corners or points so that when the user grasps the filter to install or remove it, the filter remains stiff and undamaged. Attachment is also aided by a plurality of finger recesses preferably formed in one side of the frame.

The filter also includes a connector for attaching the filter to a respirator mask. The connector protrudes through an opening in the back portion of filter material and is sealed thereto. Preferably the connector is formed integrally with the frame. Preferably the filter has a generally circular shape with the connector being slightly off-center. By having the connector located slightly off-center, the filter can be maintained in a swept back position when installed on a respirator mask thereby giving the user greater visibility when looking down. Preferably the finger recesses are formed integrally with the frame and are located on opposite sides of the connector.

The flexible frame creates a plenum in the filter so that air entering the front and back portions of the filter material can easily reach an opening in the connector without any increase in breathing resistance. The frame has a plurality of cross-members, preferably at least one cross member lying within the plane of the frame that acts as a stiffening element and several additional cross-members, which do not lie in the plane of the frame and thereby create the plenum between the front and back portions of filter material which facilitates breathing through the filter.

Other details and advantages of the present invention will become apparent as the following detailed description of the invention proceeds.

BRIEF DESCRIPTION OF THE DRAWINGS

In the accompanying drawings, preferred embodiments of the invention and preferred embodiments of practicing the invention are illustrated in which.

DETAILED DESCRIPTION OF THE PREFERRED EMBODIMENTS

Figure 1:
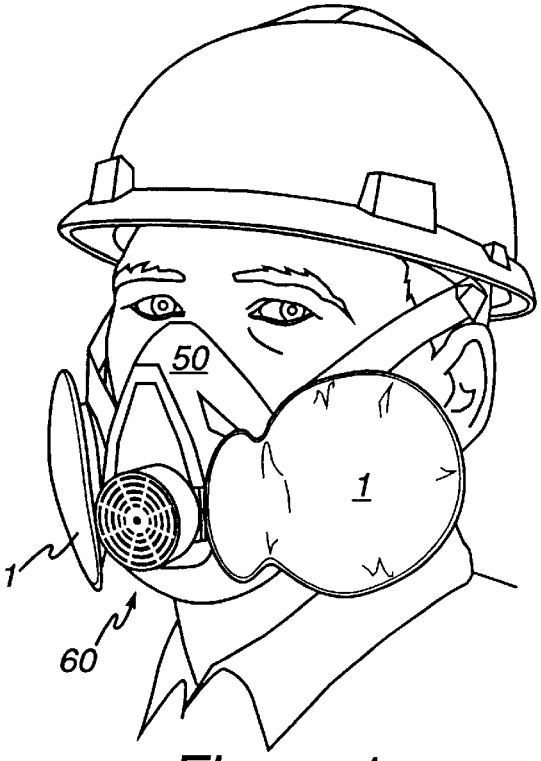
FIG. 1 shows a filter of the present invention attached to a half-mask respirator.
Figure 2:
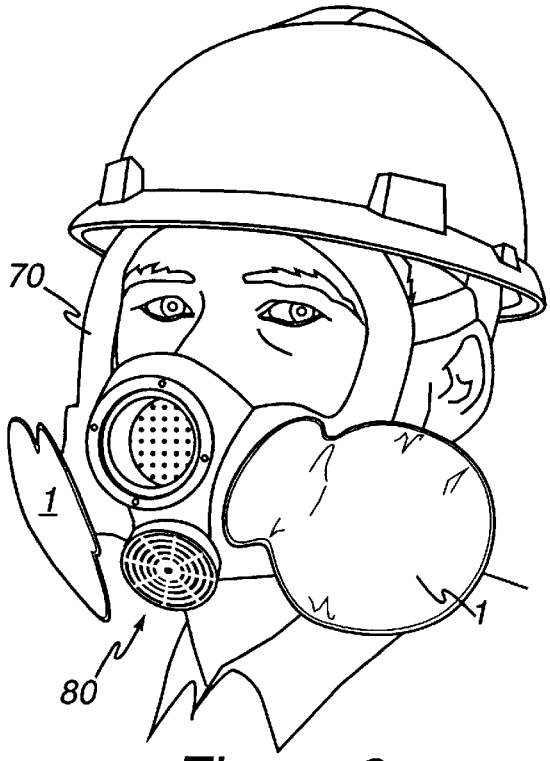
FIG. 2 shows a filter of the present invention attached to a full-face respirator.
Figure 3:
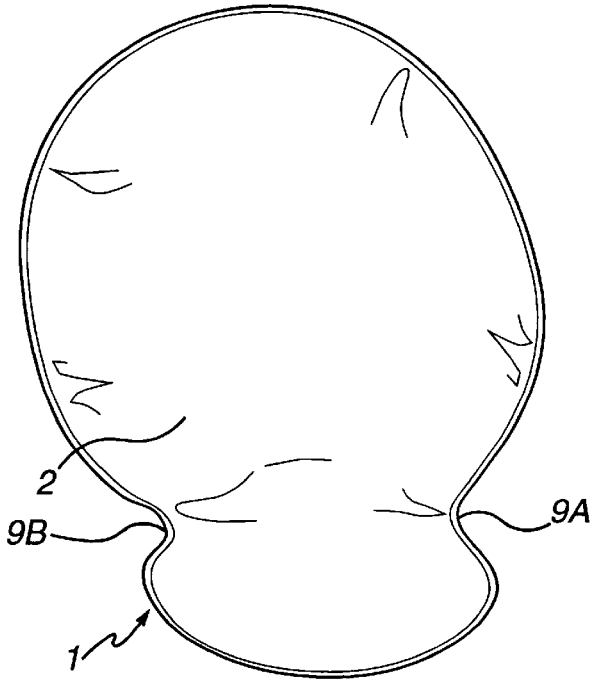
FIG. 3 shows a plan view of the front of a filter of the present invention.
Figure 4:
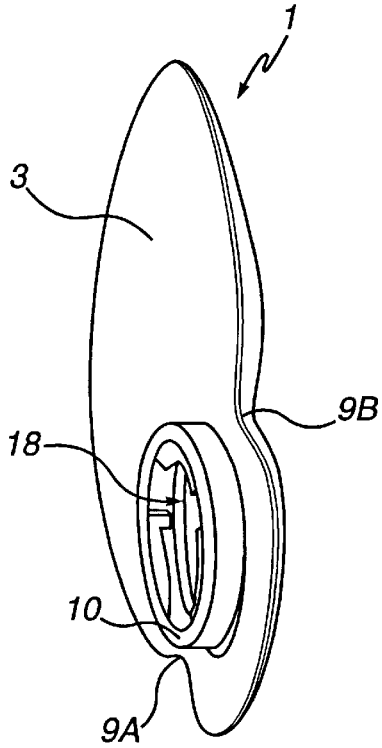
FIG. 4 shows a side view of the filter of the present invention wherein the connector can be seen.

FIG. 1 shows two flexible filters 1 of the present invention attached to the facepiece 50 of a half-mask respirator 60. FIG. 2 shows two filters 1 of the present invention attached to the facepiece 70 of a full-face respirator 80. FIG. 3 shows a top or plan view of the front of a filter of the present invention. FIG. 4 shows a side view of the filter of FIG. 3 such that the connector 10 protruding from the back of the filter can be seen. As shown in these figures, the filter 1 is generally circular in shape with a pair of recesses 9A and 9B which permit easy installation of the filter on the respirator facepiece without causing soiling and other damage to the filter. Preferably the connector 10 is located off-center of the filter such that the recesses 9A and 9B are on opposite sides of the connector 10. As shown in FIGS. 1 and 2, the sweptback design of the filter when attached to the respirator facepiece provides for improved vision and comfort. Its low profile and flexibility enable it to fit easily under a welding hood and with other personal protective equipment.

Figure 5:
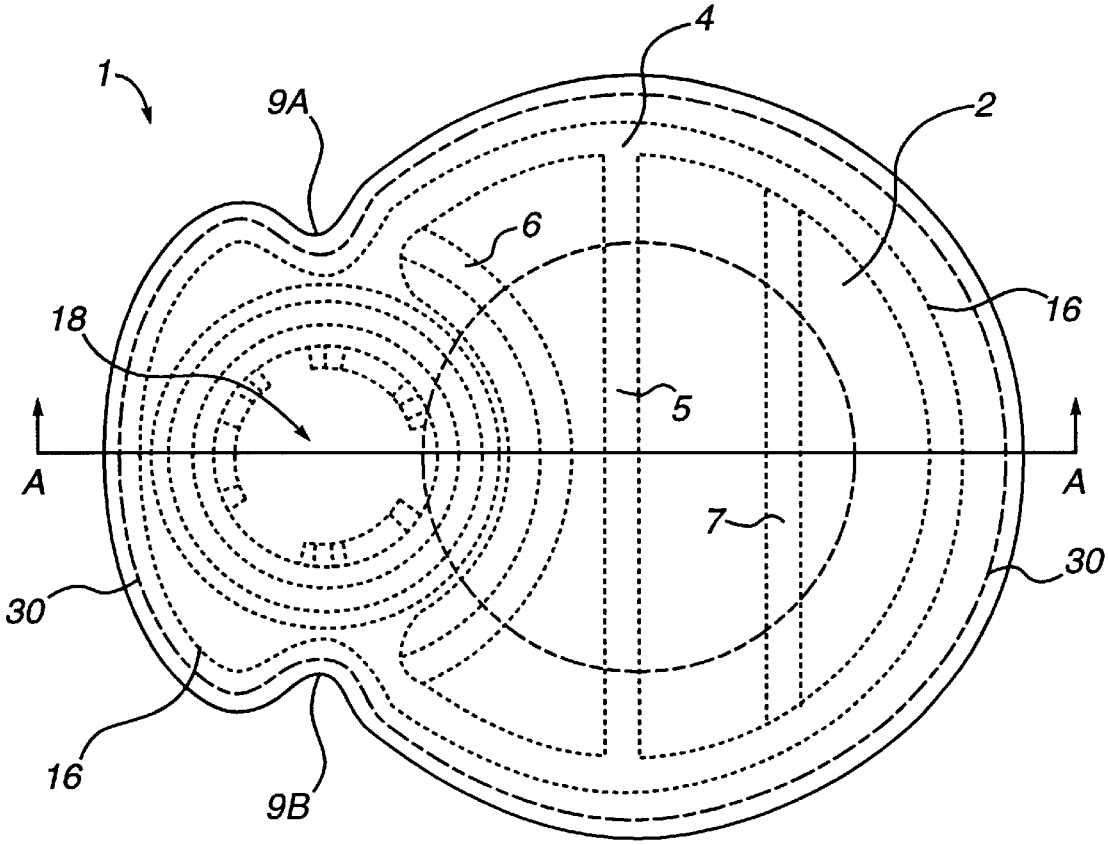
FIG. 5 shows the filter of FIG. 3 with the outline of the frame contained therein.
Figure 6:
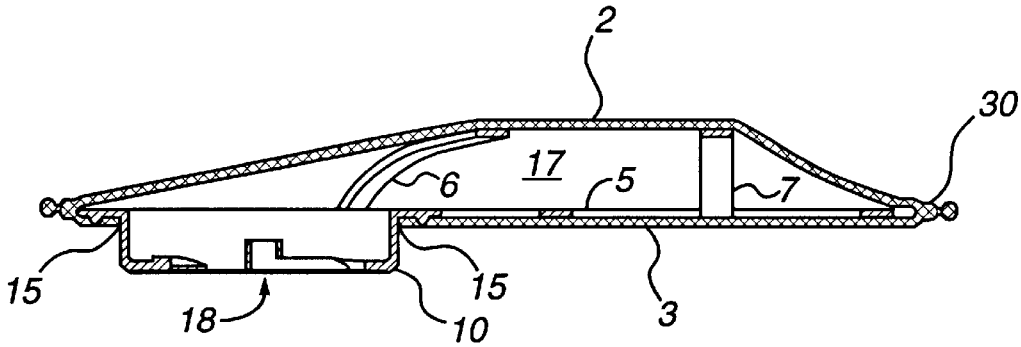
FIG. 6 shows a cross-section taken along line A—A of FIG. 5.
Figure 8:
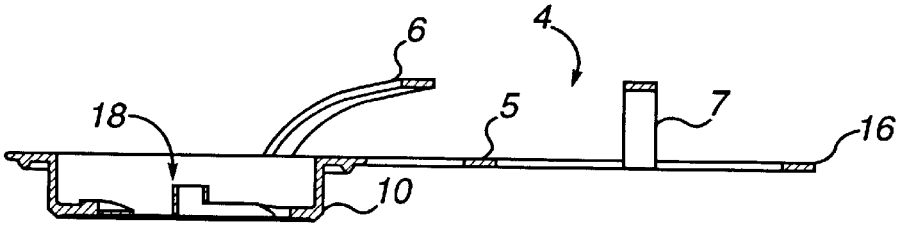
FIG. 8 shows a cross-section taken along line A—A of FIG. 7.

Referring now to FIGS. 5 and 6, there is illustrated, generally, a flexible filter 1, having a generally circular shape with a front portion 2 of the filter material, and a back portion 3 of the filter material (shown in FIGS. 4 and 6). The back portion of filter material 3 has an opening 15 through which a connector 10 having an opening 18 therethrough extends. The front portion 2 is sealed to the back portion 3 by any of several means known to one skilled in the art. Preferably ultrasonic bonding is used along the periphery of the filter material to create a sealed edge 30. Enclosed within, but preferably not connected to, the filter material is a flexible frame 4. The flexible frame 4 has substantially the same shape as the filter material with dimensions slightly smaller than the dimensions of the filter material. As such, the frame 4 is encased like a glove between front layer 2 and back layer 3 and has a perimeter 16 which is preferably located immediately adjacent to the sealed edge 30 of the filter material. Additionally, the frame has a plurality of cross-members 5, 6 and 7. As shown in FIGS. 6 and 8, cross-member 5 spans the frame and lies within the plane of the perimeter 16. Cross-members 6 and 7 are located on opposite sides of cross-member 5 and rise above the plane of the frame 4 creating the plenum 17 between front portion 2 and back portion 3.

Figure 7:
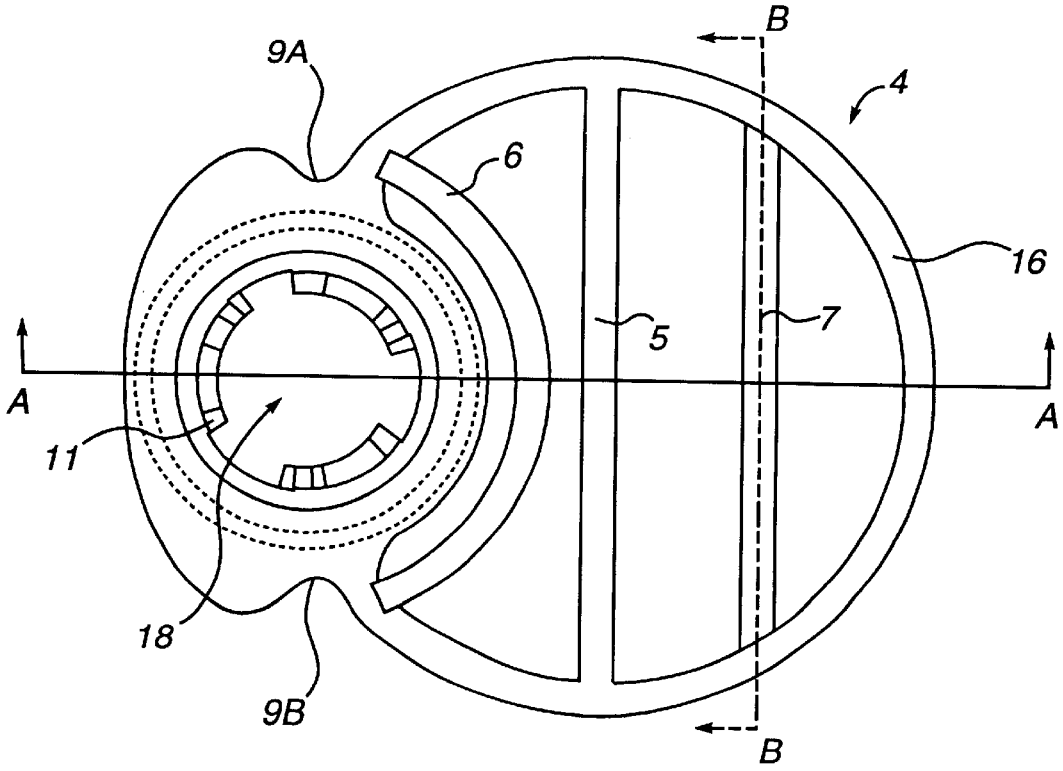
FIG. 7 shows the frame contained in the filter of FIG. 5.
Figure 9:
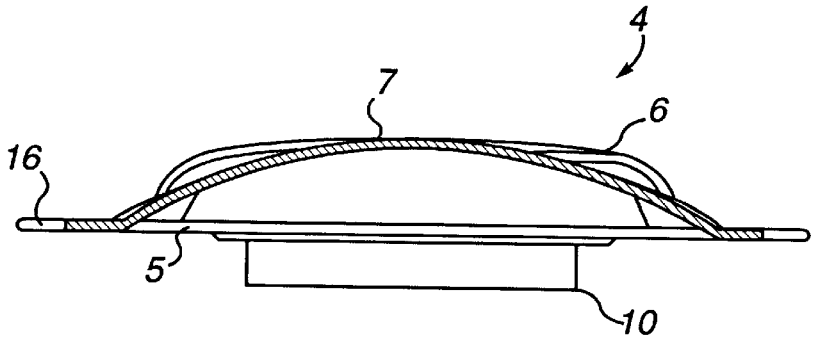
FIG. 9 shows a cross-section taken along line B—B of FIG. 5.

As shown in FIGS. 7–9, connector 10 is preferably formed integrally with the flexible frame 4, has an opening 18 therein and has a bayonet-type connector 11 for attaching the filter 1 to the respirator mask. Preferably, the connector 10 has a circular shape with a diameter much smaller than that of frame 4. The connector 10 extends below the plane of the frame and preferably is offset from the center of the frame's 4 circular shape. The connector 10 could even lie on, or beyond, the circumference of the frame 4. The outer end of the connector 10 opposite the plenum 17 is adapted to be detachably connected to a respirator mask, preferably in a single orientation by a keyed bayonet connector 11. The back portion 3 of the filter material has an opening 15 through which the connector 10 extends. The back portion of filter material 3 is sealed to connector 10 preferably by ultrasonic bonding so that the connector 10 provides a closed passageway for airflow from the plenum space to the inlet valve of the respirator mask.

As shown on FIGS. 5 and 7, there are finger tabs 9A and 9B located on either side of the connector 10 which aid in the installation of the flexible filter. The recesses 9A and 9B are preferably formed integrally with the frame 4 and lie within the plane of the frame 4. During installation, the user grips the filter 1 placing his fingers in recesses 9A and 9B, places the bayonet connector tabs into the respirator mask's keyed receiving slots and slowly turns the filter approximately thirty degrees (30°) until the bayonet connector 11 snaps in place. Removal of the filter 1 is accomplished by using the recesses 9A and 9B to grip and twist the filter in the opposite direction so that bayonet connector 11 disengages. Thus, replacement and changeout of the filter 1 can be easily accomplished without bending, crushing, or damaging.

Although the filter described herein preferably has a generally circular shape and utilizes a bayonet type connector, the invention is not limited to only these embodiments. The invention may be practiced with filters of any shape or with any type of connector. Although the present invention has been described in detail in connection with the above examples, it is to be understood that such detail is solely for that purpose and that variations can be made by those skilled in the art without departing from the spirit of the invention except as may be limited by the following claims.

What is claimed is:

1. A standalone flexible pad-type respirator filter comprising:

a flexible filter material forming substantially coextensive front and back portions, the front and back portions sealed to each other along their periphery forming a sealed edge;

a connector which protrudes through the back portion of the flexible filter material and is sealed thereto; and a flexible frame located between the front and back portions and defining a plenum which is accessible through the connector, the flexible frame having a peripheral edge which remains substantially adjacent to the sealed edge of the filter material.

2. The flexible filter according to claim 1 wherein the filter material comprises a plurality of layers.

3. The flexible filter according to claim 1 wherein the connector is formed integrally with the frame.

4. The flexible filter according to claim 1 comprising a plurality of flexible cross-members, one of which lies in a plane of the flexible frame peripheral edge and another of which extends out of the plane toward the filter material.

5. The flexible filter according to claim 4 having three flexible cross members which span the frame and wherein a middle cross member and the flexible frame peripheral edge lie in one plane and both outer cross members include a portion lying outside of the plane thereby forming the plenum between the front and back portions of the filter material.

6. The flexible filter according to claim 4 wherein the frame further comprises a plurality of recesses for grasping the filter.

7. The flexible filter according to claim 6 wherein there are two recesses which are located on opposite sides of the connector.

8. The flexible filter according to claim 1 wherein the filter is generally circular in shape and the connector is located off-center.

9. The flexible filter according to claim 8 further comprising a plurality of recesses which are located on opposite sides of the connector for grasping the filter.

10. The flexible filter according to claim 1 wherein the connector is a bayonet type such that the filter can be attached to a respirator in only one orientation.

11. In a standalone flexible pad-type respirator filter having a flexible filter material forming substantially coextensive front and back portions sealed to each other along a peripheral edge, the improvement wherein a flexible frame is disposed between the front and back portions of the flexible filter material to define a plenum therebetween, the flexible frame having a peripheral edge which remains adjacent to the sealed peripheral edge the flexible filter material along substantially the entire length of the sealed peripheral edge.

12. The flexible respirator filter according to claim 11 wherein the filter material comprises a plurality of layers.

13. The flexible filter according to claim 11 wherein the connector is formed integrally with the frame.

14. The flexible filter according to claim 11 comprising a plurality of flexible cross-members, one of which lies in a plane of the flexible frame peripheral edge and another of which extends out of the plane toward the filter material.

15. The flexible filter according to claim 11 having three flexible cross members which span the frame and wherein a middle cross member and the flexible frame peripheral edge lie in one plane and both outer cross members include a portion lying outside of the plane thereby forming the plenum between the front and back portions of the filter material.

16. The flexible filter according to claim 14 wherein the frame further comprises a plurality of recesses for grasping the filter.

17. The flexible filter according to claim 16 wherein there are two recesses which are located on opposite sides of the connector.

18. The flexible filter according to claim 11 wherein the filter is generally circular in shape and the connector is located off-center.

19. The flexible filter according to claim 18 further comprising a plurality of recesses which are located on opposite sides of the connector for grasping the filter.

20. The flexible filter according to claim 11 wherein the connector is a bayonet type such that the filter can be attached to a respirator in only one orientation.

* * * * *